US006802950B2

(12) United States Patent
Hachman, Jr. et al.

(10) Patent No.: US 6,802,950 B2
(45) Date of Patent: Oct. 12, 2004

(54) APPARATUS AND METHOD FOR CONTROLLING PLATING UNIFORMITY

(75) Inventors: John T. Hachman, Jr., Stockton, CA (US); James J. Kelly, Oakland, CA (US); Alan C. West, Tenafly, NJ (US)

(73) Assignee: Sandia National Laboratories, Livermore, CA (US)

( * ) Notice: Subject to any disclaimer, the term of this patent is extended or adjusted under 35 U.S.C. 154(b) by 0 days.

(21) Appl. No.: 10/304,175

(22) Filed: Nov. 26, 2002

(65) Prior Publication Data

US 2004/0099532 A1 May 27, 2004

(51) Int. Cl.[7] ..... C25D 21/12; C25D 17/00

(52) U.S. Cl. ..... 205/82; 204/279; 205/83; 205/84; 205/96

(58) Field of Search ..... 205/82, 83, 84, 205/96; 204/279

(56) References Cited

U.S. PATENT DOCUMENTS 6,027,631 A 2/2000 Broadbent ..... 205/137
6,103,085 A 8/2000 Woo et al. ..... 205/143
6,254,742 B1 * 7/2001 Hanson et al. ..... 204/279
6,413,388 B1 7/2002 Uzoh et al. ..... 204/224 R

OTHER PUBLICATIONS

Chalupa, R.; Cao, Y.; West, A. C.: "Unsteady Diffusion Effects in Electrodeposition in Submicron Features," *Journal of Applied Electrochemistry*, v.32, p135–143 (2002), (no month given).

Cao, Y.; Taephaisitphongse, P.; Chalupa, R.; West, A.C.: "A Three–Additive Model of Superfilling of Copper," *Journal of the Electrochemical Society*, v.148, (7) pp. C466–C472 (2001), (no month given).

* cited by examiner

*Primary Examiner*—Robert R. Koehler
(74) *Attorney, Agent, or Firm*—Timothy P. Evans

(57) ABSTRACT

The use of an insulating shield for improving the current distribution in an electrochemical plating bath is disclosed. Numerical analysis is used to evaluate the influence of shield shape and position on plating uniformity. Simulation results are compared to experimental data for nickel deposition from a nickel—sulfamate bath. The shield is shown to improve the average current density at a plating surface.

23 Claims, 9 Drawing Sheets

APPARATUS AND METHOD FOR CONTROLLING PLATING UNIFORMITY

STATEMENT OF GOVERNMENT INTEREST

This invention was made with Government support under government contract no. DE-AC04-94AL85000 awarded by the U.S. Department of Energy to Sandia Corporation. The Government has certain rights in the invention, including a paid-up license and the right, in limited circumstances, to require the owner of any patent issuing in this invention to license others on reasonable terms.

TECHNICAL FIELD

This description of embodiments of an invention generally relates to electroplating systems and more particularly, to an improved shielding apparatus and method to improve the electric field current distribution in electroplating systems.

SUMMARY

In accordance with one embodiment of the present invention, an electroplating system capable of controlling the thickness of a metal film electrodeposited onto a substrate is provided. The electroplating system includes a standard electroplating apparatus and a non-conductive shield having a certain size and one or more aperture openings that is disposed in the electroplating apparatus to selectively alter or modulate the electric field between the anode and the plating surface in this embodiment and thereby control the electrodeposition rate across the area of the plating surface.

The shield is disposed between the anode and the cathode. As a result, the electric field is modulated so that a desired time-averaged electric field current-density is applied to every point on the plating surface. Because the electrodeposition rate depends in part on the characteristics of the electric field, the uniformity of the thickness profile of the electrodeposited metal can be manipulated by the size of the shield and of the shield aperture(s).

DETAILED DESCRIPTION OF THE PREFERRED EMBODIMENTS

Figure 1:
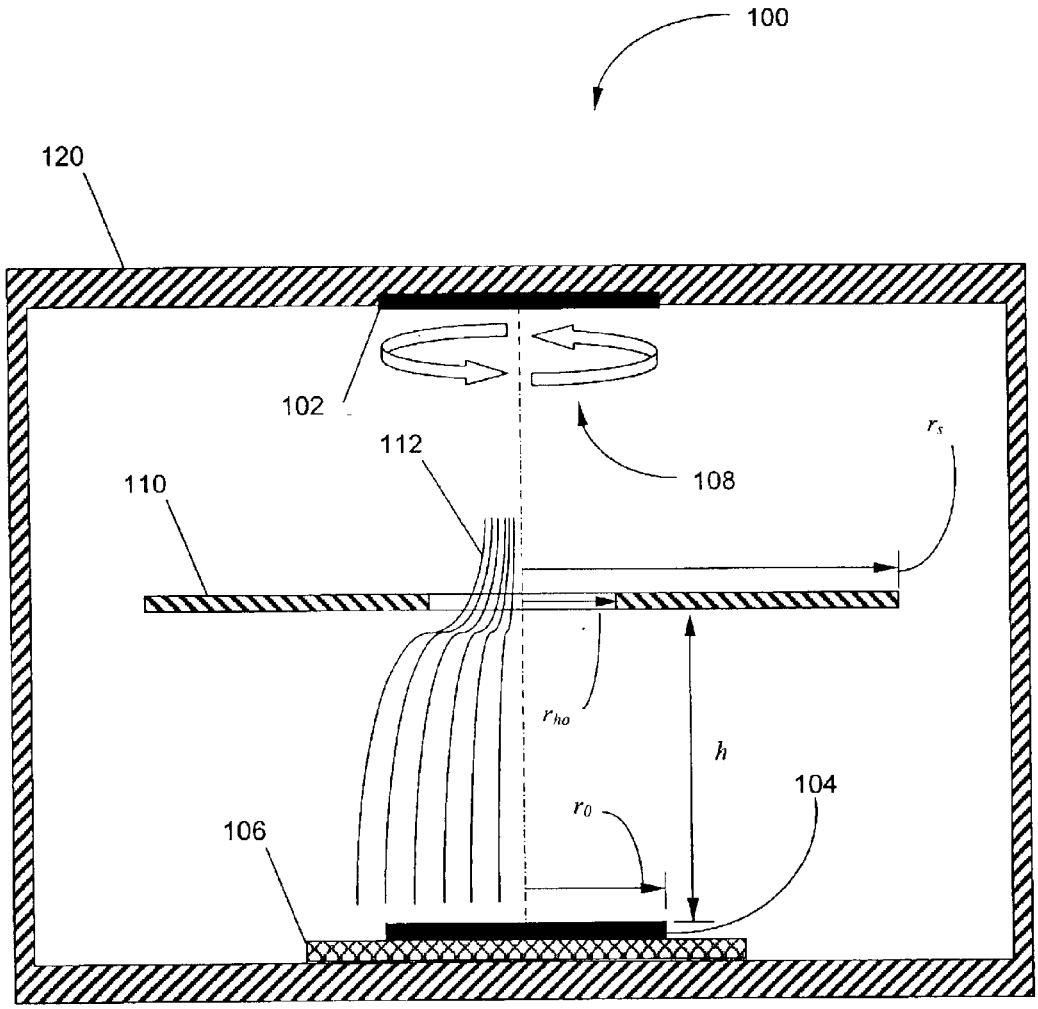
FIG. 1 is a functional block diagram of an electroplating system according to one embodiment of the invention.

FIG. 1 is a functional block diagram of an electroplating system 100 according to one embodiment of the present invention. The electroplating system 100 includes an anode 102, a cathode 104 and a voltage source (not shown) all contained within an insulating container 120. In addition, electroplating system 100 includes a shield 110 in accordance with the present embodiment and cathode 104 is rotated as indicated at 108 for uniformity.

This embodiment of electroplating system 100 is adapted for MEMS fabrication and, particularly, for electroplating a semiconductor wafer, with a useful electroplateable metal or alloy such as Cu, Ni, NiFe, NiCo, or FeMn. In the present case, nickel metal was chosen as the anode material for convenience and because of the high Faradic plating efficiency of nickel. The cathode 104 is chosen to be a silicon wafer having a conductive plating surface since this is the standard mold material used for many MEMS and LIGA parts. The reader will appreciate that when reference is made hereinafter to "the substrate", or to "the wafer," it is understood that reference is being made to cathode 104 used in the electroplating system 100.

In the present embodiment, nickel was deposited at 50° C. from a well-mixed solution of 1.54 M $Ni(SO_3NH_2)_2$ and 0.73 M boric acid. This electrolyte composition is typical for a nickel sulfamate bath used for electroforming. All chemicals were certified ACS grade. Sulfur-depolarized nickel rounds held in a bagged titanium anode basket (Titan International, Inc.) were used as a counter-electrode in a two-electrode arrangement. The pH of the electrolyte was controlled between 3.5 and 4.0, and the average thickness of the nickel film deposited at 15 mA/cm$^2$ was about 100 $\mu$m. The conductivity of this solution at 50° C. was measured to be 0.07 S/cm with a conductivity meter (Corning). Plating substrates were 3 inch diameter silicon wafers (~650 $\mu$m thick) with a copper metallization layer serving as a conductive plating base.

The arrangement of the cell is shown in FIG. 1. A 10 liter cylindrical glass jar was used as the electroplating system container 120 of the present embodiment but any non-conducting container having reasonable dimensions could also be used. In particular, the container may be generally rectilinear. Furthermore, the electrodes and plating surface (s) need not be circular but may be also rectilinear so long as the size and shape of each is chosen to avoid generating large gradients within the electric field in the cell bath.

Silicon wafer 104 was taped down to a plastic support fixture 106 comprising poly(methyl methacrylate) (e.g., Plexiglas®, Lucite®) with insulating plating tape. Electrical contact was made to the wafer by running a strip of copper tape from the top of support 106 down to the wafer 104 and then to one pole of the power supply (not shown). The exposed surfaces of the copper strip were masked with insulating tape to avoid perturbing the cell electric field when the cell was in use. Finally, insulating shield 110 (again, Plexiglass®, or Lucite®) was put in place over the wafer 104 and between it and anode 102 as shown in FIG. 1.

Wafers were weighed before and after electrodeposition to determine the average thickness of the nickel film that was eventually deposited during plating. In all cases the measured mass of nickel compared well with that which would be expected via Faraday's law (as ready mentioned the Faradic efficiency for nickel deposition is high; deposition from a sulfamate bath is known to closely approach 100%.). Nickel thickness as a function of the radial position across the surface 105 of wafer 104 was determined with a point micrometer (accurate to ±1 $\mu$m) by subtracting the initial wafer thickness from the total measured height of the plated wafer (metallized substrate and plated nickel film). To ensure that only substantially flat wafers were used, the thickness of each wafer (including the thin copper layer) was measured at several points across the surface and compared to a reference standard before deposition. Moreover, because the thickness and stiffness of the silicon wafer is several orders of magnitude greater than the deposited nickel film, no "bowing" of the wafer was expected during post-processing measurements. All of the reported values are the average of measurements across at least 5 different radii from two different wafers.

In this particular embodiment, while both anode 102 and cathode 104 are shown in FIG. 1 as disc shaped and having generally the same diameters anode 102 in practice comprises a plurality of individual nickel bodies. Moreover both anode 102 and cathode 104 are relatively disposed in an electrolytic solution so that the anode 102 and the cathode 104 are parallel and are separated by certain distance dependent upon the wafer diameter and aligned about coaxially. In the present embodiments using the 3 inch Ø wafer the separation distance is about 6 inches or about twice the diameter of the wafer. Although separated by a generally large distance other electrode configurations are possible, including a close-coupled electrode configuration, a remote or virtual anode configuration, and anodes that have a size and shape different then the size and shape of the cathode.

A voltage source (not shown) is connected to the anode 102 and the cathode 104 to set up an electric field between the anode 102 and the cathode 104, as indicated by gradient lines 112. In general, any suitable commercially available or custom electroplating apparatus with a mechanism for rotating the plating surface can be used for this embodiment of the invention. Moreover, any standard power supply capable of operating in constant current/constant potential can be used. In the present case, an Agilent® 6552A system available Agilent Technologies, Inc., was used to provide a constant current source.

In accordance with this embodiment of the invention, the shield 110 is disposed between anode 102 and the cathode 104 to selectively vary or modulate the time-averaged intensity of the electric field 112 between the anode 102 and the cathode 104. In this embodiment, the shield 110 is located about ¾ inch from the cathode 104, but the position of the shield 110 can range from ¾ inch to about 1 ½ inches anode 102 depending upon various parameters of the shield itself.

The shield 110 is preferably made of a non-conductive material that is resistant to the acid bath typically used in nickel electroplating processes. For example, the shield 110 can be made of polyethylene, polypropylene, or fluoropolymers (e.g., Teflon®, or polyvinylidene fluoride (PVDF). A mechanical bracket or collar can be used to position the shield 110 in the electroplating cell as desired. Thus, the shield 110 can be easily removed or modified as required and, further, can be easily retrofitted to existing electroplating apparatus.

Figure 2A:
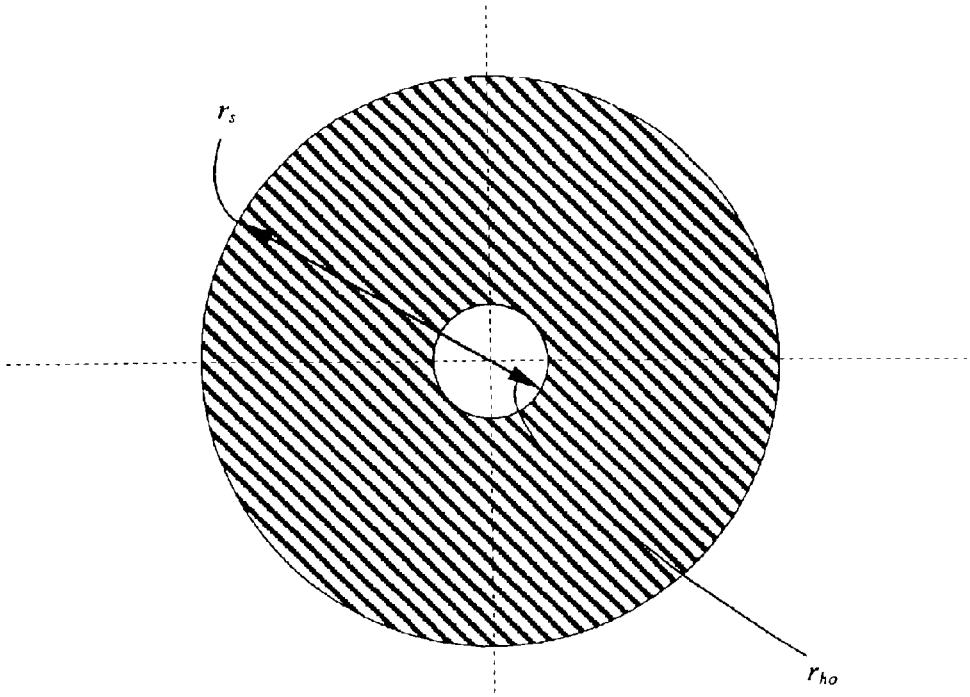
FIGS. 2A and 2B show respectively top views of a first shield having a single central opening and of a second shield having a similar central opening plus a second annular opening concentric to the first opening.
Figure 2B:
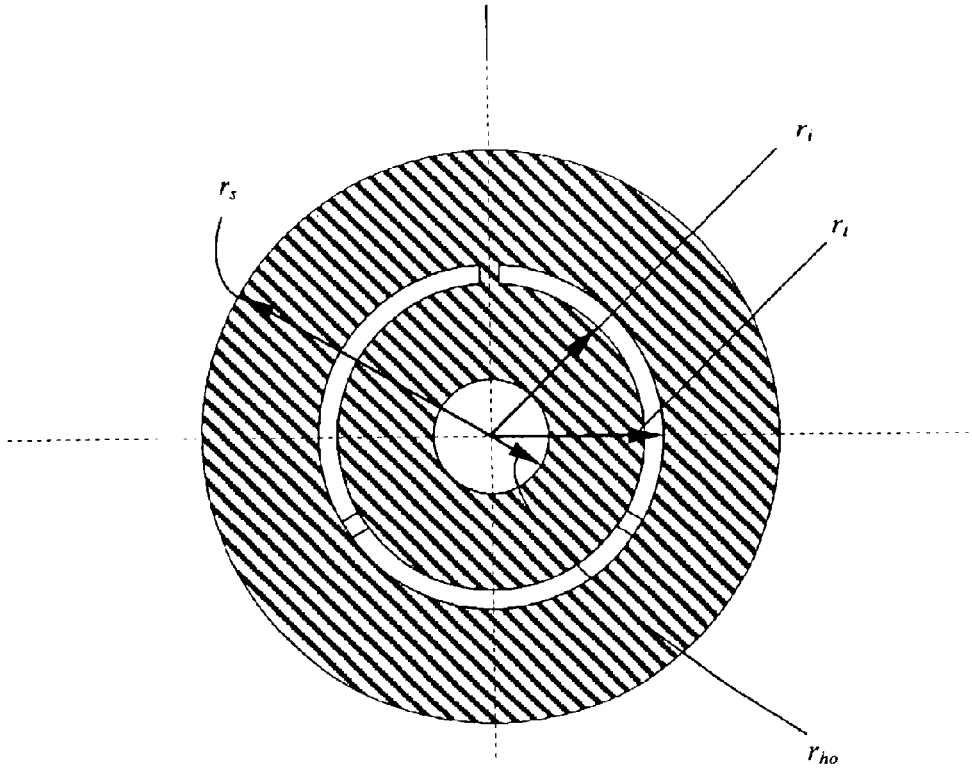

Shield 110 comprises one of two configurations shown in FIGS. 2A and 2B.

The shield 110 is shaped so that, in conjunction with the rotation of cathode 104 and the location of the shield's between the two electrodes, the time-averaged electric field 112 present between anode 102 and any particular point on the cathode plating surface 105 is controlled. Moreover, because the electric field is controlled the local electrodeposition rate of nickel across the plating surface 105 is also controlled.

FIG. 1 illustrates a cartoon of the experimental electrodeposition cell of the present embodiment showing many characteristic cell parameters and their relationship to one another. Table 1 below provides a summary of the cell parameter. (Parameters that are "normalized" were done so by comparing each with a standard wafer radius $r_0$ of 38 mm.)

Throughout the remainder of the description, most of these parameters are dealt with as "dimensionless" by setting each as a ratio of the standard wafer radius $r_o$ of 38 mm, i.e., each parameter is "normalized" with respect to the wafer radius. In particular, the wafer holder thickness and diameter were set to 0.08 and 2 respectively. Moreover, the wafer thickness is 0.02 for all wafers in the present study.

TABLE 1

| VARIABLE | VALUE |
|---|---|
| $\alpha_c$ | 0.5 |
| h | ~0.75 cm to ~2 cm |
| $\kappa$ | 0.07 $\Omega^{-1}$ $cm^{-1}$ |
| $r_i$ | 2.57 cm |
| $r_{ho}$ | ~1.3 cm to ~2.5 cm |
| $r_o$ | 3.8 cm |
| $r_s$ | ~7.6 cm to~12.16 cm |
| $r_t$ | 2.76 cm |
| $i_{avg}$ | 15 mA/$cm^2$ |
| $W_{a_T}$ | 0 to~1 |

Mathematical Model

A mathematical model was developed to provide insight as to which parameters are most influential for uniform deposition and against which our experimental results might be compared. It is assumed that the electrolyte bath is well mixed and that any variation in ion concentration throughout the bath is negligible. As such, the current density i, is determined by the gradient of the electrical potential $\phi$.

$$i=-\kappa\nabla\phi \quad (1)$$

where the electrolyte conductivity $\kappa$ is presumed to be constant. The potential field is then determined by Laplace's equation, which for the present case is most conveniently written in cylindrical coordinates as:

$$\frac{\partial^2\phi}{\partial r^2}+\frac{1}{r}\frac{\partial\phi}{\partial r}+\frac{\partial^2\phi}{\partial z^2}=0 \tag{2}$$

Along the insulating wafer holder, the current shield, and all insulating walls, the normal component of the electrical potential gradient is zero, i.e., $$\bar{n}\cdot\bar{\nabla}\phi=0 \tag{3}$$

where $\bar{n}$ is the unit vector normal to the surface. Moreover, the boundary condition along the counter-electrode is assumed to be an imposed uniform current density:

$$(\bar{n}\cdot\bar{\nabla}\phi)=-\frac{i_{avg}}{\kappa} \tag{4}$$

where $i_{avg}$ is an average current density on the cathode. Because the counter-electrode position was sufficiently removed from cathode surface 105, the boundary condition represented by equation (4) had an insignificant influence on the results. Employment of equation 4 is a computationally convenient method of setting the total current flowing in the electrochemical cell.

At cathode surface 105, a Tafel kinetics relationship is assumed:

$$\frac{\partial\phi}{\partial z}=-\frac{i_o}{\kappa}\exp\left(-\frac{\alpha_c F(V-\phi)}{RT}\right)\quad \text{at } z=0,\ r\le r_o \tag{5}$$

where $\alpha_c$ is the cathodic charge transfer coefficient.

The numerical calculations were performed by well known boundary element methods previously described in the literature (see for instance Radek Chalupa, Yang Cao, and Alan C. West, "Unsteady Diffusion Effects in Electrodeposition in Submicron Features," *Journal of Applied Electrochemistry*, v.32, p135 (2002); and Yang Cao, Premratn Taephaisitphongse, Radek Chalupa, Alan C. West, "A Three-Additive Model of Superfilling of Copper," *Journal of the Electrochemical Society*, v.148, (7) pp. C466–C472 (2001), both herein incorporated by reference) and validated. The node density was systematically varied to ensure that the numerical error associated with the grid was less than approximately 2 percent. Further grid refinements to achieve greater accuracy was not required for the present purpose of obtaining an optimal shield design.

Results depend on several ratios of the cell dimensions as well as a Tafel Wagner number defined as:

$$W_{a_T}=\frac{\kappa RT}{|i_{avg}|\alpha_c r_o F} \tag{6}$$

FIG. 2 shows the calculated current distribution for several Wagner numbers that would result when a shield is not employed. As expected, the computed current distributions become more uniform as the Wagner number increases. For the case of $W_{a_T}$=0.07, experimental results are also shown and are in good agreement with simulation, as is readily seen.

As suggested by the range of the parameters listed in TABLE 1, only the dimensions of overall shield radius and aperture radius were systematically varied in the present investigation. The dimensionless shield thickness was found not to be an important parameter, and its value was set at 0.08. Furthermore, for most of the experimental results reported here $i_{avg}$=15 mA/cm$^2$, $\kappa$=0.07 $\Omega^{-1}$cm$^{-1}$, $r_o$=3.8 cm as to provide a Tafel-Wagner number of $W_{a_T}$=0.07.

As one might expect, the parameters found to be of most significance to the present study are the ratio of aperture radius to the wafer radius $r_{ho}/r_o$; the separation distance between the shield and wafer (normalized to wafer radius) $h/r_o$; and the ratio of shield radius to the wafer radius $r_s/r_o$.

FIGS. 3A–C and 4A–C show the effect on deposition thickness when using shields (design A) having one of three different aperture sizes $r_{ho}/r_o$; at separation distances $h/r_o$, of 0.25 (FIG. 3) and of 0.28 (FIG. 4), respectively ($W_{a_T}$=0.07 and $r_s/r_o$=2). In each case the experimental measurements were found to be in good agreement with the numerical simulations. Moreover, as suggested by FIGS. 3A and 4A ($r_{ho}/r_o$; =0.34), as the aperture size is made smaller, the film thickness t, near the wafer center becomes unacceptably large. Furthermore, for aperture sizes $r_{ho}/r_o$>0.7 (results not shown), film thickness t, begins to approximate the results of FIG. 2 for the case of no shield.

Figure 5A:
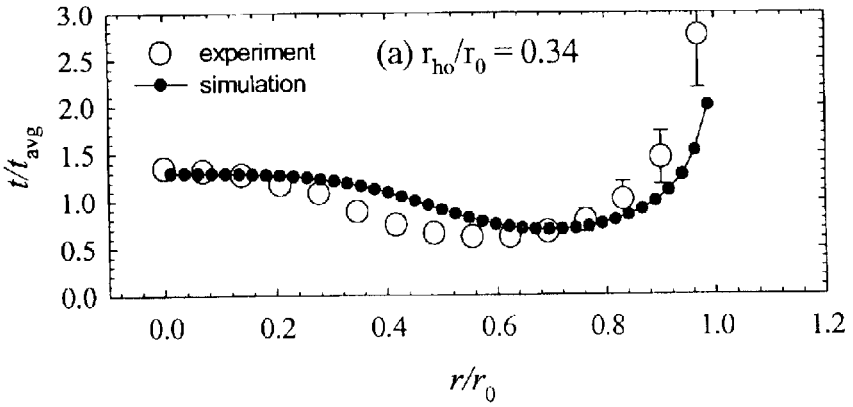
FIGS. 5A, 5B, and 5C show experimental and numerical simulation results for the electrodeposited film thickness, normalized by the average film thickness on a 3 inch wafer respectively, using shields of FIG. 2A having one of the three aperture sizes of FIG. 4, wherein each shield is positioned at a second separation distance above the plating surface.
Figure 5B:
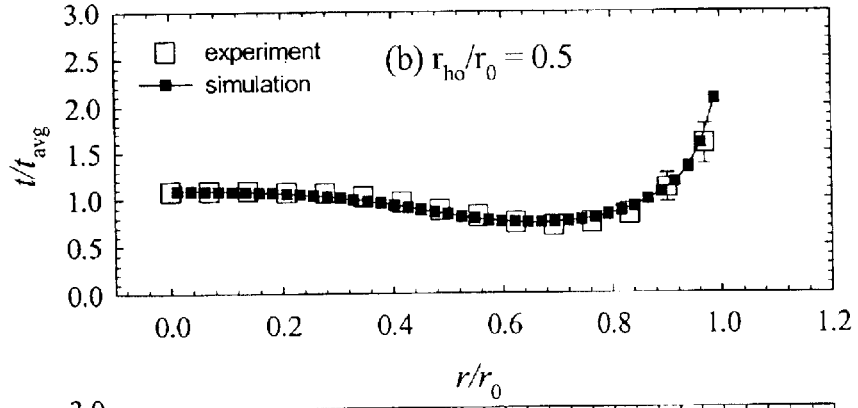
Figure 5C:
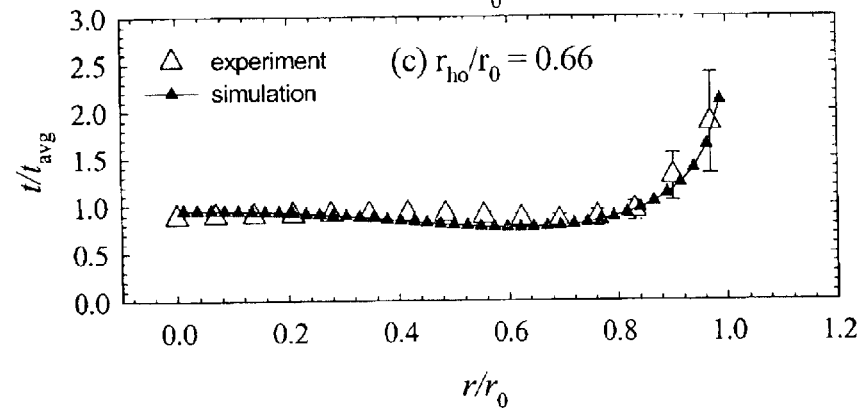

FIGS. 5A–5C show the influence of shield separation distance $h/r_0$, over a fairly narrow range for the case of $r_{ho}/r_o$=0.5, again with $W_{a_r}$=0.07, and $r_s/r_o$=2. It is seen from these results that as the separation distance is reduced to $h/r_o$<0.2, the thickness distribution becomes significantly altered near the wafer center as compared to the example of FIGS. 3C ($h/r_o$=0.25). Furthermore, setting $h/r_o$ between about 0.25 and about 0.34, provides much less variation in film thickness across the wafer surface. However, as with too large an aperture size, numerical simulation indicates that when separation distance exceeds about 0.7, film thickness deposition approaches what would be expected for the no-shield case.

Figure 3:
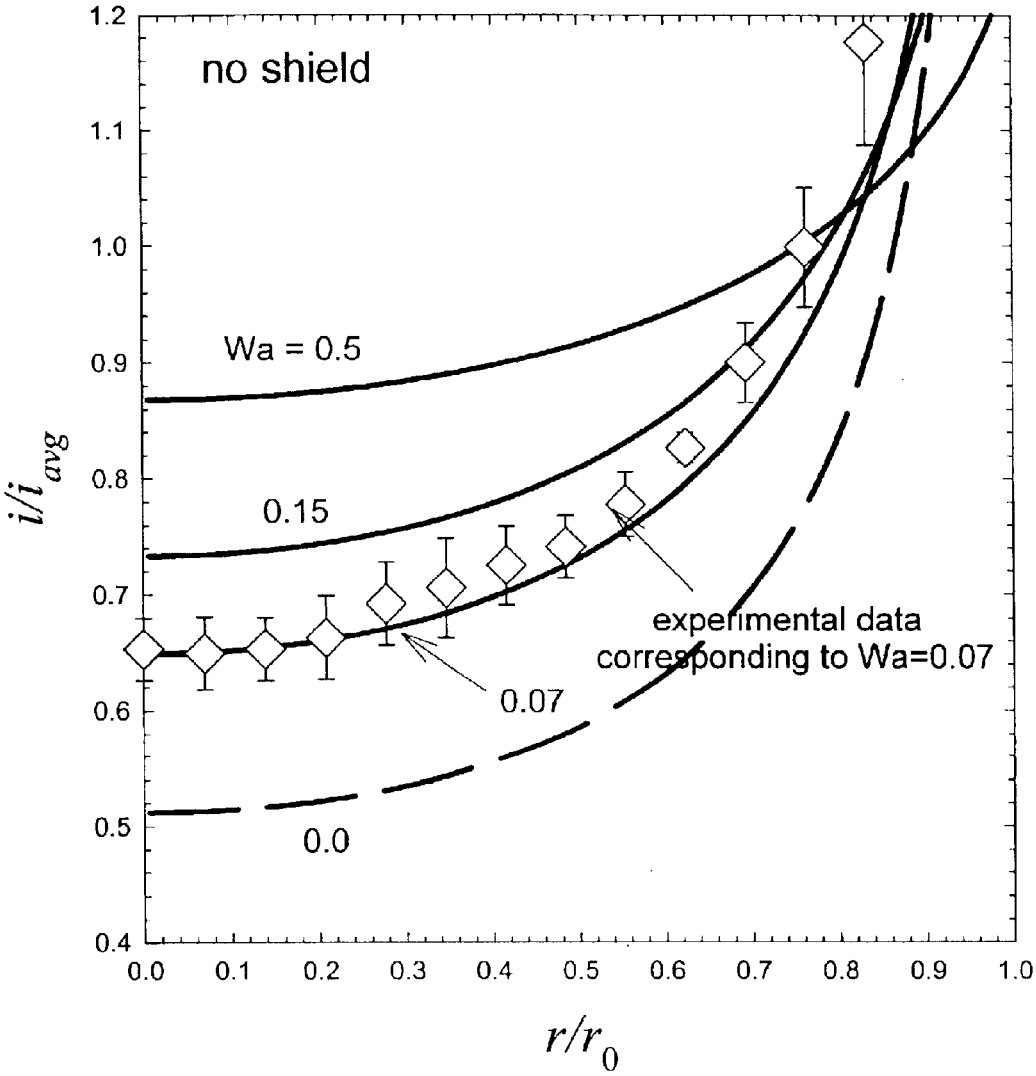
FIG. 3 shows experimental results and several numerical simulations for electrodeposition onto a 3 inch wafer without the use of a shield.
Figure 4A:
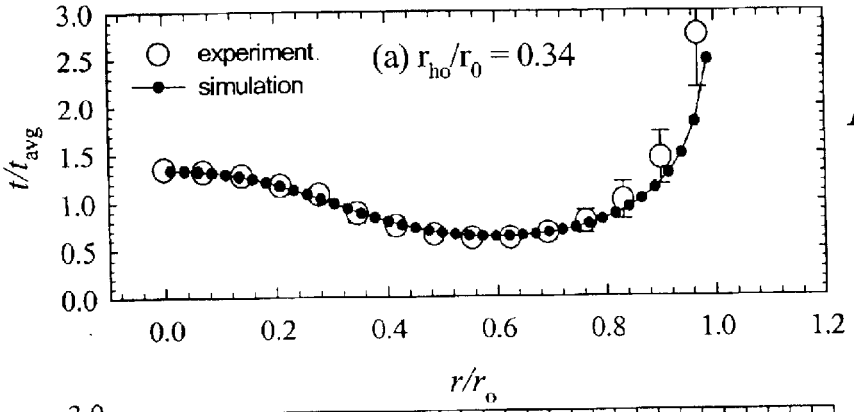
FIGS. 4A, 4B, and 4C show experimental and numerical simulation results for the electrodeposited film thickness, normalized by the average film thickness on a 3 inch wafer respectively, using shields of FIG. 2A having one of three different aperture sizes, wherein each shield is positioned at a first separation distance above the plating surface.
Figure 4B:
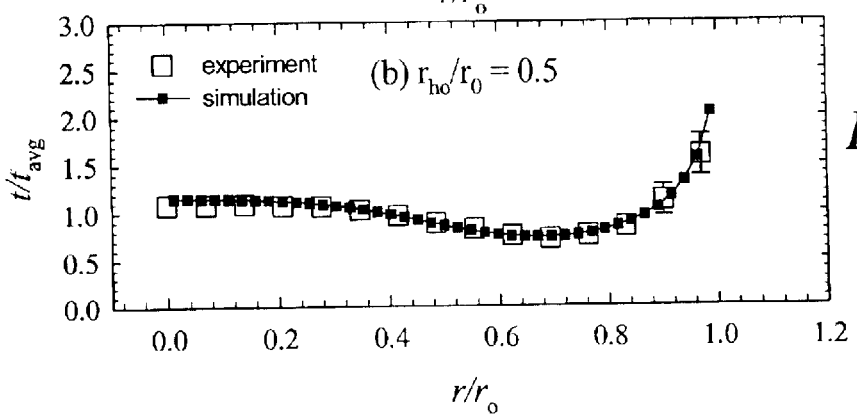
Figure 4C:
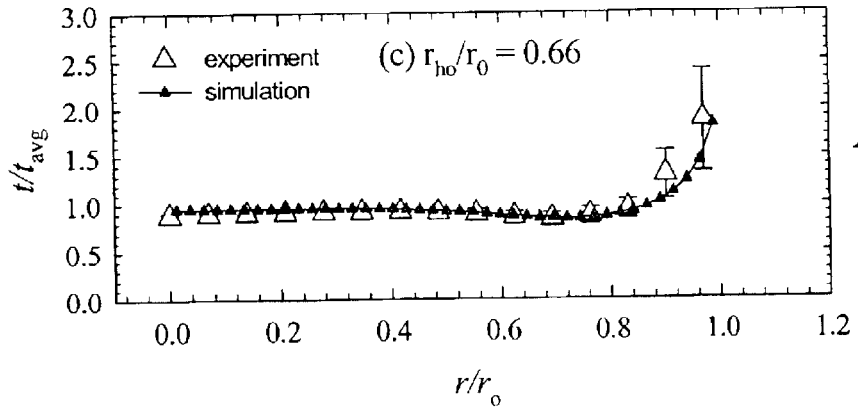
Figure 6A:
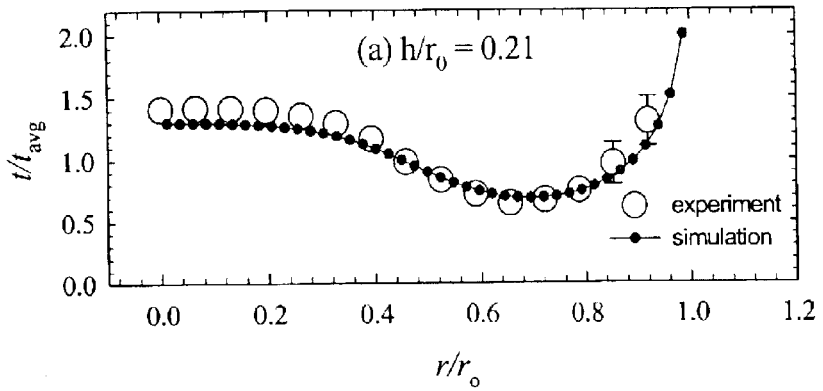
FIGS. 6A, 6B, and 6C show experimental and numerical simulation results for the electrodeposited film thickness normalized by the average film thickness on a 3 inch wafer respectively using one of three shields of FIG. 2A each shield positioned at either the second, a third, or a fourth separation distance above the plating surface.
Figure 6B:
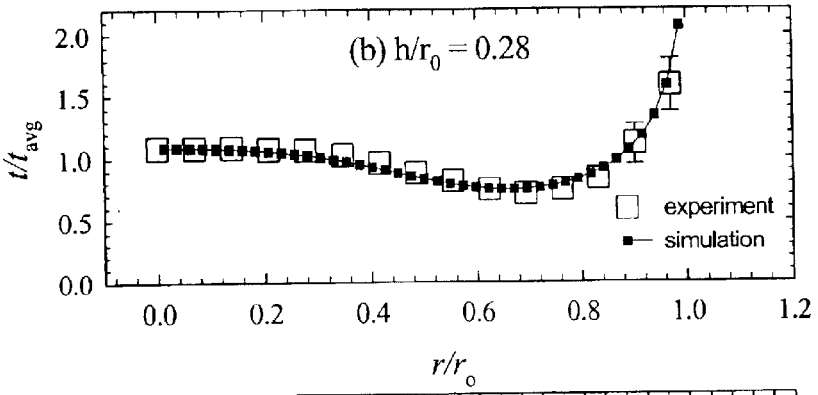
Figure 6C:
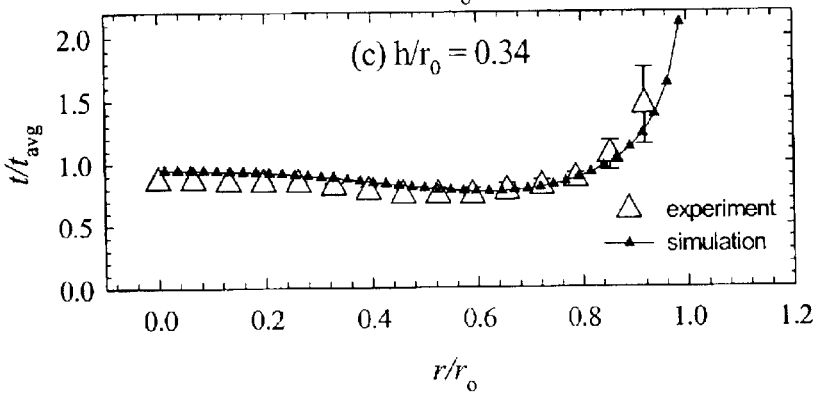
Figure 7A:
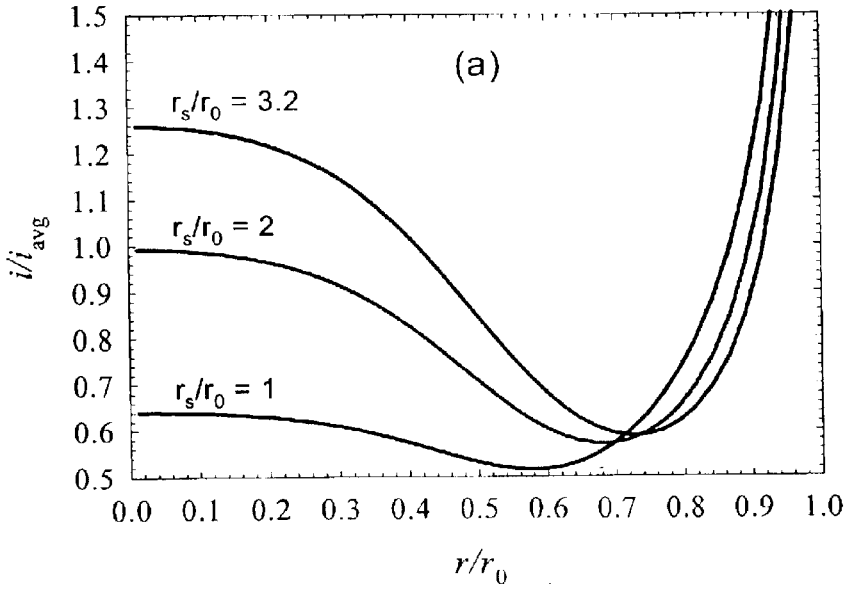
FIGS. 7A, and 7B show a numerical simulation of current distribution normalized by the average current density at the shield illustrating the influence of the shield radius for the shield designs of FIGS. 2A and 2B, respectively.
Figure 7B:
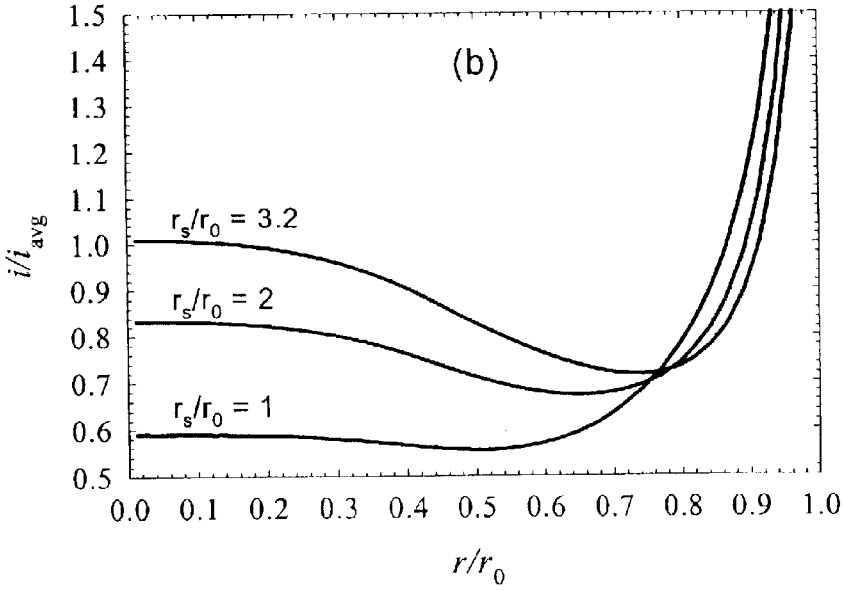

Results shown in FIGS. 3–5 (numerical simulation and experimental), therefore, suggest that there is an optimal shield separation distance and aperture radius. Additionally, simulation results showing the influence of the overall shield radius $r_s/r_o$ as presented in FIGS. 6A and 6B, suggest that current distribution near the wafer center increases as the size of the shield increases, and that for each shield size the current distribution reaches a minimum near $r/r_o$=0.7 further suggesting that a shield designed with a second opening concentric with the central aperture, might moderate the observed minimum in the current (and therefore, deposition) profile. The numerical simulations shown in FIGS. 6B and 7B demonstrate that for the case in which the midpoint of the annular opening is centered at about $r_s/r_o$=0.7 current distribution could be improved.

Based on these simulation results, shield design B shown in FIG. 2B was constructed. The modified design comprises a shield with a narrow annular opening surrounding the central aperture wherein the inside edge of the annular opening $r_i/r_o$ is scaled to be equal to 0.675, and the outside edge of the opening $r_t/r_o$ is equal to 0.725 with several small bridging elements connecting the inner aperture to the body of the shield.

Figure 8A:
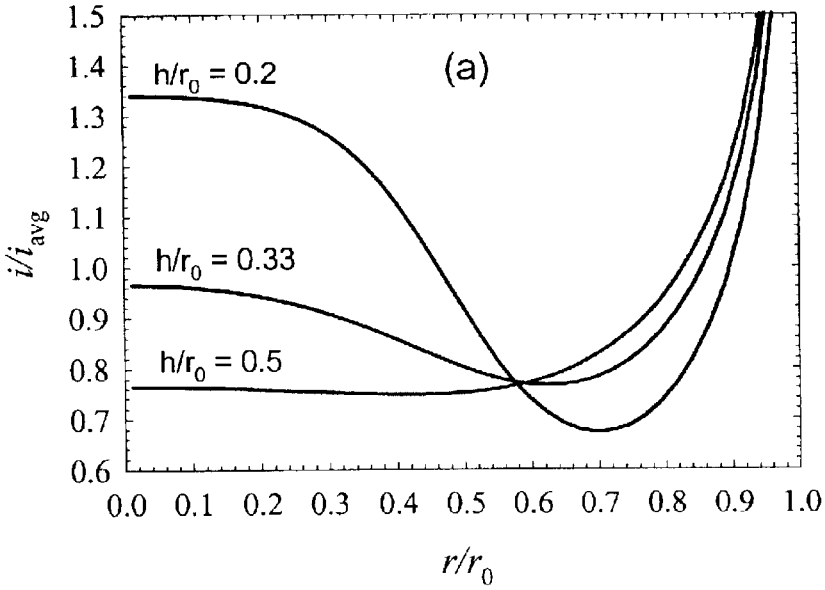
FIGS. 8A, and 8B show a numerical simulation of current distribution normalized by the average current density at the shield illustrating the influence of the shield separation distance above the plating surface for the shield designs of FIGS. 2A and 2B, respectively.
Figure 8B:
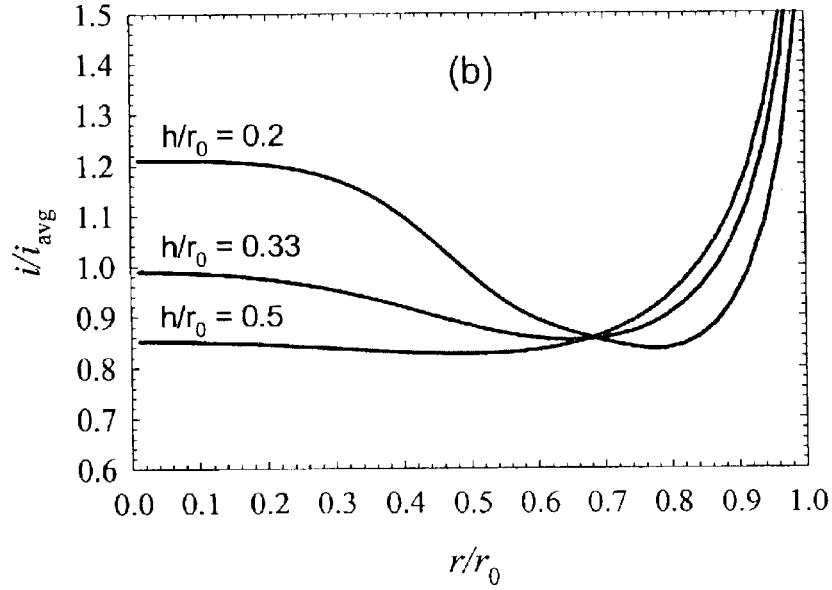
Figure 9A:
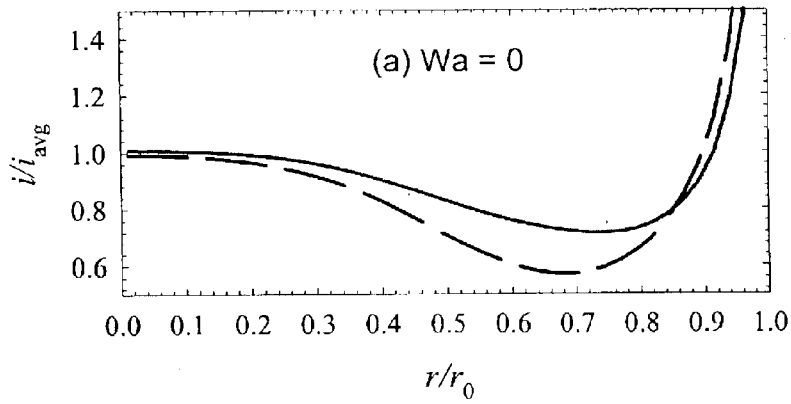
FIGS. 9A, 9B, and 9C show a numerical simulation of current distribution normalized by the average current density at the shield illustrating the influence of three different Wagner numbers using the shield designs of FIGS. 2A (dashed line) and 2B (solid line). Experimentally measured points are shown in FIG. 9B superimposed over the solid and dashed lines.
Figure 9B:
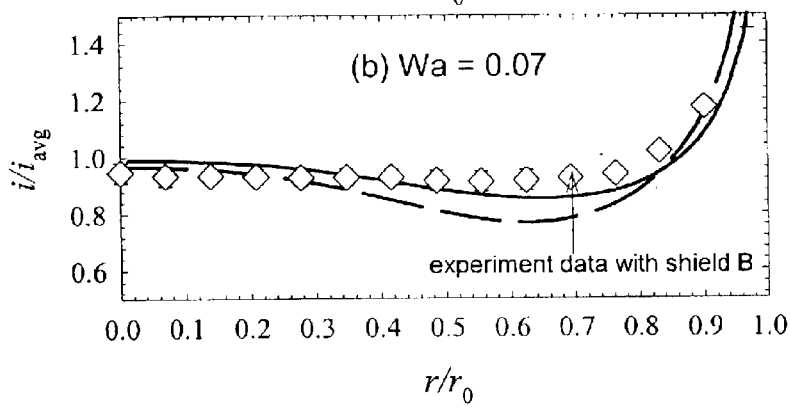
Figure 9C:
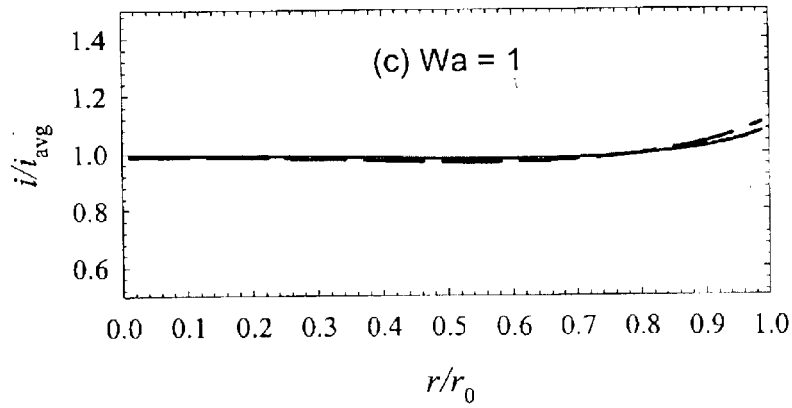

Simulation and experimental data shown in FIGS. 8A–8C compares the effect the shield design change on current distribution for three different Tafel-Wagner numbers. Dashed lines represent the current distribution in a cell designed with shield A and assume that $r_{ho}/r_o$=0.5, $h/r_o$=0.34, and $r_s/r_o$=2. Solid lines show the current distribution for a cell designed with shield B ($r_i/r_o$=0.675 and $r_t/r_o$=0.725), and assume that $r_{ho}/r_o$=0.5, $h/r_o$=0.34, and $r_s/r_o$=3.2.

The effect of the shield modification on measured current distribution is shown in FIG. 8B for a Tafel-Wagner number of 0.07 and is seen to closely track the simulation data of shield design B. Moreover, these results strongly suggest that current distribution in cells using the modified shield (B) will be more uniform than in cells that use the un-modified shield (A): using a shield with a central aperture reduces the maximum deviation in the current distribution by about 20% of its average near the cathode center (for $r/r_o \leqq 0.7$), while an improved design implementing a slot appropriately placed around the aperture reduces the variation to less than about 10% of its average (again, for $r/r_o \leqq 0.7$).

What is claimed is:

1. An intermediate member for modifying an electric field in an electrochemical plating cell, comprising:

an electrically nonconducting disc disposed between an anode and a cathode and about parallel to a surface of said cathode, wherein said cathode comprises a radius $r_o$, and wherein said electrically nonconducting disc comprises an central opening having a radius $r_{ho}$, greater than about 0.5 $r_o$ and less than about 0.7 $r_o$, and wherein said central opening is disposed about coaxially with a center line normal to said cathode surface.

2. The intermediate member of claim 1, wherein said electrically nonconducting disc further comprises a disc radius $r_s$, wherein said radius $r_s$ is at least as large as radius $r_o$.

3. The intermediate member of claim 2, wherein said radius $r_s$ is equal to between about $r_o$ and about 2 $r_o$.

4. The intermediate member of claim 1, wherein $r_{ho}$ is equal to about 0.66 $r_o$.

5. The intermediate member of claim 1, wherein the electrically nonconducting disc comprises a mechanically stable material compatible with an acidic liquid environment.

6. The intermediate member of claim 5, wherein the electrically nonconducting disc is selected from the group of materials consisting of polyethylene, polypropylene, and fluoropolymers.

7. An intermediate member for modifying an electric field in an electrochemical plating cell, comprising:

an electrically nonconducting disc disposed between an anode and a cathode and about parallel to a surface of said cathode, wherein said cathode comprises a radius $r_o$, and wherein said electrically nonconducting disc comprises a central opening having a radius, $r_{ho}$, greater than about 0.5 $r_o$ and less than about 0.7 $r_o$, and a segmented, annular opening concentric to said central opening, and wherein said openings are disposed about coaxially with a center line normal to said cathode surface.

8. The intermediate member of claim 7, wherein said electrically nonconducting disc further comprises a disc radius $r_s$, wherein said radius $r_s$ is at least as large as radius $r_o$.

9. The intermediate member of claim 7, wherein said radius $r_s$ is equal to between about $r_o$ and about 2 $r_o$.

10. The intermediate member of claim 7, wherein $r_{ho}$ is equal to about 0.66 $r_o$.

11. The intermediate member of claim 7, wherein the electrically nonconducting disc comprises a mechanically stable material compatible with an acidic liquid environment.

12. The intermediate member of claim 11, wherein the electrically nonconducting disc is selected from the group of materials consisting of polyethylene, polypropylene, and fluoropolymers.

13. The intermediate member of claim 7, wherein said segmented annular opening comprises an inner radius $r_i$ and an outer radius $r_t$, wherein $$\frac{r_t + r_i}{2} \cong 0.7 r_o.$$

14. The intermediate member of claim 13, wherein $$(r_t + r_i) \cong 0.05\ r_o.$$

15. An electrochemical plating system, comprising:

an electrically nonconducting disc disposed between an anode and a cathode and about parallel to a surface of said cathode, wherein said cathode comprises a radius $r_o$, and wherein said electrically nonconducting disc comprises a central opening having a radius, $r_{ho}$, greater than about 0.5 $r_o$ and less than about 0.7 $r_o$, and a segmented, annular opening concentric to said central opening, and wherein said openings are disposed about coaxially with a center line normal to said cathode surface.

16. The electrochemical system of claim 15, wherein said electrically nonconducting disc further comprises a disc radius $r_s$, wherein said radius $r_s$ is at least as large as radius $r_o$, said disc further disposed at a distance from said cathode surface equal to about 0.34 $r_o$ to less than 0.5 $r_o$.

17. The electrochemical system of claim 16, wherein said radius $r_s$ is equal to between about $r_o$ and about 2 $r_o$.

18. The electrochemical system of claim 17, wherein $r_{ho}$ is equal to about 0.66 $r_o$.

19. The electrochemical system of claim 15, wherein the electrically nonconducting disc comprises a mechanically stable material compatible with an acidic liquid environment.

20. The electrochemical system of claim 18, wherein the electrically nonconducting disc is selected from the group of materials consisting of polyethylene, polypropylene, and fluoropolymers.

21. The electrochemical system of claim 16, wherein said segmented annular opening comprises an inner radius $r_i$ and an outer radius $r_t$, wherein $$\frac{r_t + r_i}{2} \cong 0.7 r_o.$$

22. The electrochemical system of claim 21, wherein $(r_t + r_i) \cong 0.05\ r_o$.

23. A method for increasing plating deposition uniformity across a plating surface in an electrochemical plating system, comprising the step of:

disposing an electrically nonconducting shield disposed between an anode and a cathode in said electrochemical plating system, wherein said cathode comprises a radius $r_o$, and wherein said shield comprises a central opening having a radius, $r_{ho}$, greater than about 0.5 $r_o$ and less than about 0.7 $r_o$, and a segmented, annular opening concentric to said central opening;

orienting said shield about parallel to a surface of said cathode, wherein said openings are disposed about coaxially with a center line normal to said cathode surface; and setting said shield at a distance from said cathode surface equal to about 0.34 $r_o$ to less than about 0.5 $r_o$.

* * * * *